US006183619B1

(12) United States Patent
Gillman et al.

(10) Patent No.: US 6,183,619 B1
(45) Date of Patent: Feb. 6, 2001

(54) METAL ALLOY SULFONIC ACID ELECTROPLATING BATHS

(75) Inventors: Hyman D. Gillman, Spring City, PA (US); Brenda Fernandes, Cranston; Kazimierz Wikiel, South Kingston, both of RI (US)

(73) Assignees: Technic, Inc., Cranston, RI (US); Specialty Chemical Systems, Inc., Royersford, PA (US)

( * ) Notice: Under 35 U.S.C. 154(b), the term of this patent shall be extended for 0 days.

(21) Appl. No.: 09/272,551

(22) Filed: Mar. 19, 1999

(51) Int. Cl.[7] ..... C25D 3/02

(52) U.S. Cl. ..... 205/238; 205/252; 205/254; 205/261; 205/302; 106/1.25

(58) Field of Search ..... 205/252, 253, 205/254, 238, 261, 302; 106/1.25

(56) References Cited

U.S. PATENT DOCUMENTS

| | | | | |
|---|---|---|---|---|
| 2,525,942 | * | 10/1950 | Proell | 205/281 |
| 4,207,150 | | 6/1980 | Creutz et al. | 204/55 |
| 4,459,185 | | 7/1984 | Obata et al. | 204/43 |
| 4,717,460 | | 1/1988 | Nobel et al. | 204/444 |
| 4,764,262 | | 8/1988 | Lemke | 204/49 |
| 4,828,657 | | 5/1989 | Fukuoka et al. | 204/44.4 |
| 4,849,059 | | 7/1989 | Deresh et al. | 204/44.4 |
| 4,871,429 | | 10/1989 | Nobel et al. | 204/44.4 |
| 5,051,154 | | 9/1991 | Bernards et al. | 204/24 |
| 5,066,367 | | 11/1991 | Nobel et al. | 204/44.4 |
| 5,174,886 | | 12/1992 | King et al. | 205/125 |
| 5,492,615 | | 2/1996 | Houman | 205/238 |
| 5,538,617 | | 7/1996 | Steinbicker et al. | 205/302 |
| 5,562,814 | | 10/1996 | Kirby | 205/238 |
| 5,750,017 | | 5/1998 | Zhang | 205/104 |
| 5,759,381 | * | 6/1998 | Sakurai et al. | 205/252 |

FOREIGN PATENT DOCUMENTS

| | | |
|---|---|---|
| 0 787 834 A1 | 1/1987 | (EP) . |
| 0 455 166 A1 | 6/1991 | (EP) . |

OTHER PUBLICATIONS

Meibuhr et al., *Noble Metal Resistors in Microcircuits*, "The Mechanism of the Inhibition of Stannous–Ion Oxidation by Phenolsulfonic Acid", vol. 2, No. 9–10, Sep.–Oct. 1964 pp. 267–273.

* cited by examiner

*Primary Examiner*—Kishor Mayekar
(74) *Attorney, Agent, or Firm*—Ernest V. Linek; Banner & Witcoff, Ltd.

(57) ABSTRACT

The use of alkali metal, alkaline earth metal, ammonium and substituted ammonium salts of alkyl and alkanol sulfonic acids as additives in pure metal and metal alloy sulfonic acid electroplating baths has a number of unexpected benefits including wider useful current density range, improved appearance and in the case of tin improved oxidative stability. An additional significant appearance is to reduce the overall costs of this type of bath with the more economical salts of alkyl and alkanol sulfonic acids. The metals and metal alloys include but are not limited to tin, lead, copper, nickel, zinc, tin/lead, tin/lead/copper, tin/zinc and zinc/nickel.

16 Claims, No Drawings

METAL ALLOY SULFONIC ACID ELECTROPLATING BATHS

CROSS-REFERENCE TO RELATED APPLICATIONS

The present invention is related to the following commonly owned applications filed on even date herewith; Metal Alloy Halide Electroplating Baths, U.S. Ser. No. 09/272,550; Metal Alloy Fluoroborate Electroplating Baths, U.S. Ser. No. 09/273,119; and Metal Alloy Sulfate Electroplating Baths, U.S. Ser. No. 09/272,800; all pending, the disclosures of which are hereby incorporated herein by reference.

BACKGROUND OF THE INVENTION

Electroplating solutions are usually aqueous. Every plating solution contains ingredients to perform at least the first, and usually several, of the following functions: (1) provide a source of ions of the metal(s) to be deposited; (2) form complexes with ions of the depositing metal; (3) provide conductivity; (4) stabilize the solution against hydrolysis or other forms of decomposition; (5) buffer the pH of the solution; (6) regulate the physical form of the deposit; (7) aid in anode corrosion; and (8) modify other properties peculiar to the solution involved.

The present invention improves the plating performance of the solution, particularly by increasing the useful current density over previously accepted norms. The current density is the average current in amperes divided by the area through which that current passes; the area is usually nominal area, since the true area for any but extremely smooth electrodes is seldom known. Units used in this regard are amperes per square meter ($A/m^2$).

It is generally in the best interest of efficiency to run electroplating baths at as high a current density as possible. The higher the current density, the faster the coating plates on the surface. As the current density increases, the thickness of the coating on the surface likewise increases. The current is carried by the ions in these baths and each type of ion has its own specific conductance. In a plating bath however, ionic conductance is only one variable that must be considered in choosing an electrolyte. The final criterion is the quality of the coating at the desired current density.

SULFONIC ACID BATHS

In the last decade the commercial use of sulfonic acid metal plating baths has increased considerably because of a number of performance advantages. See for example U.S. Pat. Nos. 5,750,017; 4,849,059; 4,764,262 and 4,207,150. This growth has slowed dramatically in the last few years because of large increases in the cost of the alkyl sulfonic acid. The preferred sulfonic acid used has been methane sulfonic acid (MSA) although the prior art includes examples of other alkyl and alkanol sulfonic acids. These other alkyl or alkanol sulfonic acids are more expensive than methane sulfonic acid and are therefore not competitive with methane sulfonic acid.

Several manufacturers produce salts of 2-hydroxy ethyl sulfonic acid (isethionic acid) commercially on a large scale but it is not commonly available in the free acid form. These salts are considerably less expensive than methane sulfonic acid but in the present plating technology only the acid form of the alkyl or alkanol sulfonic acid is used in the bath.

The performance advantages of alkyl sulfonic acid baths include low corrosivity, high solubility of salts, good conductivity, good oxidative stability of tine salts and complete biodegradability. The predominant metals plated in these sulfonic acid baths are tin, lead and copper as well as alloys of these metals with each other.

SUMMARY OF THE INVENTION

The present invention relates to the use of salts of alkyl and alkanol sulfonic acid which were found to improve the performance of sulfonic acid, especially alkyl sulfonic acid electroplating baths. Advantageously the salts are selected from the group consisting of alkali metal, alkaline earth metal, ammonium and substituted ammonium salts of 2-hydroxy ethyl sulfonic acid (isethionic acid).

When used in electroplating baths such as MSA, these salt additives were found to generally increase the plating range so that the baths can be used at much higher current densities. Thus these baths can achieve greater speeds than baths without these additives can. Further improvements are seen in the quality of the deposits. In the case of stannous alkyl sulfonate plating solutions some improvement in the oxidative stability of the tin was also observed.

As an added benefit, these salts are not harmful to the environment, they are completely biodegradable and the products of the biodegradation are common ions and molecules found in the environment. In addition they have a number of other advantages including high solderability, low corrosivity to equipment, good stability at high temperatures, and compatibility with many other metal salts.

Generally these baths will also contain the corresponding metal salt or metal salts if an alloy plate is required, and various additives to control the quality and appearance of the plated surface and the stability of the bath solution. Typical additives include a surfactant such as an ethoxylated fatty alcohol, a brightening agent if required and an antioxidant such as hydroquinone or catechol, if tin is one of the metals being plated.

The tin in these baths is in the stannous or reduced form. If oxidation occurs the tin will be converted to the stannic or oxidized form which then commonly precipitates to form sludge. This process adds to the inefficiency of these baths and also creates a requirement for constant filtering. Prior art patents, for example U.S. Pat. Nos. 4,717,460, 5,538,617 and 5,562,814, describe products that can decrease the amount of tin being oxidized.

Another advantage of using the salts of alkyl or alkanol sulfonates is that they are much less expensive than their corresponding acid. Currently the only bulk commercial alkyl/alkanol sulfonic acid suitable for electroplating is methane sulfonic acid and the only bulk commercial alkali/alkaline earth/ammonium alkyl/alkanol sulfonate salt suitable for electroplating is sodium isethionate. When comparing the price of these two large commercial products the sodium isethionate is less than half the price of the methane sulfonic acid either on a mole basis or on a weight basis.

DETAILED DESCRIPTION OF THE INVENTION

There has been little previous use of alkali/alkaline earth/ammonium alkyl/alkanol sulfonate salts in electroplating, and when used, the salts were first converted to acids. The present invention thus is directed to the direct use of these salts in electroplating. The use of such salts will enable the viability of inexpensive production technology such as the Steckler process to produce these salts. For example:

$$CH_3Cl+Na_2SO_3-CH_3SO_3Na+NaCl$$

In this reaction, the sodium chloride can be crystallized out and the resulting sodium methane sulfonate can then be used in an electroplating bath.

EXAMPLES

The present invention will be further illustrated with reference to the following examples which aid in the understanding of the present invention, but which are not to be construed as limitations thereof All percentages reported herein, unless otherwise specified, are percent by weight. All temperatures are expressed in degrees Celsius. Commercially available plating components are identified by their sources.

Lowering Levels of Free Acid and Making Additions of Sodium Isethionate:

Plating tests have proven than additions of sodium isethionate to a known MSA Tin/Lead system allow the decrease of the amount of methane sulfonic acid required in the plating bath. The decrease in MSA, with the addition of sodium isethionate allows for optimum bath performance with a decrease in cost and an overall lightening of the tin or tin/lead deposit. Plating tests were performed with a decrease of the acid to ⅓ typical level and no negative effects were noted. Some plating tests showed a significant improvement of the overall deposit with additions of sodium isethionate. A decrease in the burn and band(s) opened up the upper CD range. A commercially available plating system (TECHNIC MSA 90/10, Technic, Inc.) had an increase in CD range from 120 ASF to greater than 240 ASF.

It has been found that the overall benefits of the addition of sodium isethionate vary from plating system to plating system, but decreasing the total free acid (MSA) up to ⅔ (66%) by the addition of sodium isethionate was acceptable in the examples that follow.

A typical commercial MSA plating system contains approximately 15% v/v MSA. The results that follow reflect plating tests performed with two plating baths made with two different levels of MSA. The first bath, EXAMPLES #1 and #2 were made with 15% v/v MSA and EXAMPLES #3 and #4, were made with 5% v/v MSA, lowered the resistivity of the solution therefore higher amperage was achieved. (See Examples #3 and #4).

Plating performance tests were conducted using the HCHC (Hydrodynamically Controlled Hull Cell). Due to the increase in agitation versus a typical Hull Cell setup, the overall benefits at the upper current densities (CD's) can be noted with the additions of sodium isethionate. The results show the width of the burn and band in mm, if applicable. Both the burn and band, at the HCD to MCD region, influence the overall operable CD Range of the plating bath. The CD Range noted in the final column of the result tables, indicates the CD range for the optimal deposit. The addition of Sodium Isethonate to the plating baths, decreased or eliminated the burn and band, widening the optimum CD Range.

The plating tests performed at 5% v/v MSA, had no banding at the HCD region. However, the maximum amperage obtainable with 5% v/v MSA was 10 amps. The addition of 15 g/l sodium isethionate to a system containing only 5% v/v MSA allowed the application of up to 20 amps. See the result tables that follow.

Bath Solution:

15% v/v MSA 55 g/l Sn (as stannous methane sulfonate)

12 g/l Pb (as lead methane sulfonate)

2 g/l TECHNI Tin/Lead Salt #2 (Technic Inc.)

5% v/v TECHNI 800 HS MakeUp (Technic Inc.)

1% v/v TECHNI 800 HS Secondary "A" (Technic Inc.)

Plate Conditions: 10 a, 1 min, 1500 rpm, 110° F. An increase in amperage was attempted for this plating system under these plate conditions.

Example #1 shows the results of the plating bath listed above with no sodium isethionate additions.

Example #2 shows the results of the plating bath listed above, under the same plating conditions with a 15 g/l sodium isethionate addition.

Example #1

| Amperage: | Additions: | Burn/mm: | Band at HCD/ mm: | CD Range: |
|---|---|---|---|---|
| 10a, 1 min | NONE | 3 mm | 10 mm | 400–1 ASF |
| 15a, 1 min | NONE | 15 mm | 15 mm | 400–1 ASF |
| 20a, 1 min | NONE | 60 mm | 5 mm | 200–1 ASF |

Example #2

| Amperage: | Additions: | Burn/ mm: | Band at HCD's/ mm: | CD Range: |
|---|---|---|---|---|
| 10a, 1 min | 15 g/l Sodium Isethionate | 2 mm | NONE | +400–1 ASF |
| 15a, 1 min | 15 g/l Sodium Isethionate | 7 mm | NONE edge | +600 ASF–LCD |
| 20a, 1 min | 15 g/l Sodium Isethionate | 7 mm edge | NONE | +800 ASF–LCD |

Bath Solution:

5% v/v MSA 55 g/l Sn (as stannous methane sulfonate)

12 g/l Pb (as lead methane sulfonate)

2 g/l TECHNI Tin/Lead Salt #2 (Technic Inc.)

5% v/v TECHNI NF 800 HS MakeUp (Technic Inc.)

1% v/v TECHNI NF 800 HS Secondary "A" (Technic Inc.)

Plate Conditions: 10a, 1 min, 1500 rpm, 110° F. An increase in amperage was attempted for this plating system under these plate conditions.

Example #3 shows the results of the plating bath listed above, with no sodium isethionate additions.

Example #4 shows the results of the plating bath listed above, under the same plating conditions with a 15 g/l sodium isethionate addition.

Using the Hull Cell Ruler, the CD ranges of both 10 amp panels look similar. However, the initial panel without the presence of sodium isethionate, has treeing along the panel edge. There is no treeing visible on the panel with the sodium isethionate addition. In application, the presence of the treeing would actually narrow the operating range of the plating bath.

Example #3

| Amperage: | Additions: | Burn/mm: | Band at HCD/mm: | CD Range: |
|---|---|---|---|---|
| 10a, 1 min | NONE | 3 mm, with treeing along the HCD edge | NONE | +400–60 ASF |
| 15a, 1 min | NONE | Unable to achieve 15 amps, 10 amps max. | | |
| 20a, 1 min | NONE | Unable to achieve 20 amps, 10 amps max. | | |

Example #4

| Amperage: | Additions: | Burn/mm: | Band at HCD/mm: | CD Range: |
|---|---|---|---|---|
| 10a, 1 min | 15 g/l sodium isethionate | 2 mm, no treeing | NONE | +400–60 ASF |
| 15a, 1 min | 15 g/l sodium isethionate | 2 mm, no treeing | NONE | +600–LCD |
| 20a, 1 min | 15 g/l sodium isethionate | 10 mm, no treeing | NONE | +800–LCD |

Different sodium sources were added to a pure Tin MSA and banding was significantly decreased or eliminated completely. The change in the banding widened the current density range significantly, opening the operating window of the system.

Bath Composition:

10% v/v MSA 20 g/l Sn (as stannous methane sulfonate)

0.1 g/l salicylic acid 3 g/l Jeffox WL 5000 (Huntsman)

5 ppm 2,9-Dimethyl-1,10-phenanthroline

Plating Conditions: Using the HCHC 10a, 1 min, 1500 rpm, 100° F.

Example #5

| Additions: | Burn/mm: | Band in LCD's/mm: | CD Range: |
|---|---|---|---|
| NONE | 5 mm | 25 mm | 400–200 ASF |
| 1 g/l sodium methane sulfonate | 5 mm | 25 mm | 400–200 ASF |
| 10 g/l sodium methane sulfonate | 5 mm | 20 mm | 400–200 ASF |
| 20 g/l sodium methane sulfonate | 5 mm | NONE | 400–60 ASF |

The same MSA Tin plating bath was prepared as above, and additions of sodium isethionate were made.

Plating Conditions: Using the HCHC 10a, 1 min, 1500 rpm, 100° F.

Example #6

| Additions: | Burn/mm: | Band at the LCD's/mm: | CD Range: |
|---|---|---|---|
| NONE | 5 mm | 25 mm | 400–200 ASF |
| 5 g/l sodium isethionate | 2.5 mm | 20 mm | 400–200 ASF |
| 20 g/l sodium isethionate | 2.5 mm | NONE | 400–20 ASF |

Looking at the CD ranges, both sodium methane sulfonate and sodium isethionate additions look to have similar benefits. The additions of sodium isethionate are preferred however, since the sodium isethionate minimizes the burn as compared to the sodium methane sulfonate. In practice there would be a wider operating window. In addition, the sodium isethionate lightens the overall deposit evenly across the entire CD range.

Example #7

This example illustrates the ability of the alkanol sulfonate salt to inhibit the oxidation of the stannous ion in methane sulfonate based tin plating bath solutions.

Air was bubbled through 100 ml of the following solutions at a rate of 100 ml/minute, at room temperature for 288 hours.

| RUN # | $Sn(O_3SCH_3)_2$ $Sn^{+2}$ g/liter | $FeSO_4$ $Fe^{+2}$ g/liter | $NaO_3S(CH_2)_2OH$ g/liter | $HO_3SCH_3$ g/liter | Decrease in $Sn^{-2}$ Concentration g/liter |
|---|---|---|---|---|---|
| 1 | 23 | 10 | 0 | 0 | 5.7 |
| 2 | 23 | 10 | 30 | 0 | 4.2 |
| 3 | 23 | 10 | 0 | 15 | 4.5 |
| 4 | 23 | 10 | 30 | 15 | 3.6 |

The present invention has been described in detail, including the preferred embodiments thereof However, it will be appreciated that those skilled in the art, upon consideration of the present disclosure, may make modifications and/or improvements on this invention and still be within the scope and spirit of this invention as set forth in the following claims.

What is claimed is:

1. A method of improving the plating performance of sulfonic acid based electroplating baths, comprising the step of replacing at least a portion of the alkyl sulfonic acid electrolyte with a salt of an alkanol sulfonic acid or of a mixture of an alkyl sulfonic acid and an alkanol sulfonic acid, wherein the replacement salt is selected from the group consisting of alkali metal, alkaline earth metal, and ammonium or substituted ammonium salts.

2. The method of claim 1, wherein the sulfonic acid is an alkyl sulfonic acid.

3. The method of claim 2, wherein the alkyl sulfonic acid is methane sulfonic acid.

4. The method of claim 1, wherein the salt is a salt of 2-hydroxy ethyl sulfonic acid.

5. The method of claim 1, wherein the electroplating bath is a tin electroplating bath.

6. The method of claim 1, wherein the electroplating bath is a lead electroplating bath.

7. The method of claim 1, wherein the electroplating bath is a tin/lead electroplating bath.

8. A method of increasing the useful upper current density range of a tin methane sulfonate plating bath and thereby allowing tin plating at higher speeds, said method comprising the step of adding an effective amount of sodium or potassium methane/methanol sulfonate to the bath.

9. A method of increasing the useful upper current density range of a tin/lead methane/methanol sulfonate plating bath and thereby allowing plating at higher speeds, said method comprising the step of replacing at least a portion of the methane sulfonic acid with sodium isethionate.

10. The method of claim 9, wherein up to 50% of the methane sulfonic acid is replaced by sodium isethionate.

11. The method of claim 9, wherein up to 75% of the methane sulfonic acid is replaced by sodium isethionate.

12. The method of claim 9, wherein up to 90% of the methane sulfonic acid is replaced by sodium isethionate.

13. A method of inhibiting the oxidation of stannous ions in a tin plating bath containing methane sulfonic acid as the electrolyte, comprising the step of adding an effective amount of a salt of an alkanol sulfonic acid or of a mixture of an alkyl sulfonic acid and an alkanol sulfonic acid, wherein the adding salt is selected from the group consisting of alkali metal, alkaline earth metal, and ammonium or substituted ammonium salts.

14. An aqueous sulfonic acid electroplating bath comprising:

(a) an alkyl or alkanol sulfonic acid electrolyte;

(b) one or more soluble platable metal salts, wherein the platable metal is selected from the group consisting of tin, lead, copper, cadmium, indium, iron and mixtures thereof; and (c) a salt of a mixture of an alkyl sulfonic acid and alkanol sulfonic acid in an amount to improve the plating performance of the aqueous sulphonic acid electroplating baths, wherein the salt is selected from the group consisting of alkali metal, alkaline earth metal, and ammonium or substituted ammonium salts.

15. The electroplating bath of claim 14, wherein the sulfonic acid salt is a salt of 2-hydroxy ethyl sulfonic acid.

16. The electroplating bath of claim 15, wherein the sulfonic acid salt is sodium isethionate.

* * * * *